US011879711B1

(12) United States Patent
Pegouske et al.

(10) Patent No.: US 11,879,711 B1
(45) Date of Patent: Jan. 23, 2024

(54) RADIAL RIGID UNDERWATER BETWEEN-STRUCTURE EXPLOSIVE CUTTING CAVITY (RRUBECC) CONTAINER

(71) Applicant: The United States of America as Represented by the Secretary of the Navy, Indian Head, MD (US)

(72) Inventors: Adam Pegouske, White Plains, MD (US); Lee Foltz, Indian Head, MD (US); Daniel McCarthy, LaPlata, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 65 days.

(21) Appl. No.: 17/300,438

(22) Filed: Jun. 30, 2021

(51) Int. Cl.
*F42B 3/08* (2006.01)
*F42B 1/02* (2006.01)
*F42D 3/00* (2006.01)

(52) U.S. Cl.
CPC ..... *F42B 3/08* (2013.01); *F42B 1/02* (2013.01); *F42D 3/00* (2013.01)

(58) Field of Classification Search
CPC ..... F42B 3/08; F42B 1/00; F42B 1/02; F42D 3/00; F42D 1/00
USPC ..... 102/307
See application file for complete search history.

(56) References Cited

U.S. PATENT DOCUMENTS 3,013,491 A 12/1961 Poulter
3,185,089 A 5/1965 Parkhurst et al.
3,233,688 A 2/1966 Bell
3,855,929 A * 12/1974 Ridgeway ..... F42B 3/08 102/307
4,099,464 A 7/1978 Cross et al.
4,109,576 A * 8/1978 Eckels ..... F42B 3/22 102/307
4,126,092 A * 11/1978 Cross ..... F42B 1/02 89/1.14
4,151,798 A * 5/1979 Ridgeway ..... F42B 3/08 102/307
4,889,183 A 12/1989 Sommers et al.
5,415,101 A * 5/1995 Brinkmann ..... F42B 1/02 102/307
5,551,346 A 9/1996 Walters et al.
7,536,956 B2 * 5/2009 Sammons ..... F42B 1/024 102/306
7,954,433 B1 6/2011 Barnett
8,006,621 B1 8/2011 Cherry
(Continued)

FOREIGN PATENT DOCUMENTS

EP 0846838 6/1998
FR 2067874 A5 * 8/1971 ..... F42B 3/08

*Primary Examiner* — James S Bergin
(74) *Attorney, Agent, or Firm* — Fredric J Zimmerman

(57) ABSTRACT

A radial cutting cavity container includes a housing that defines a chamber for a shaped explosive charge. The housing is configured to allow a user to pack explosives therein. An airtight cavity is attached to the housing. The airtight cavity defines a standoff distance for the shaped explosive charge and has a concave surface adapted to form an explosive cutting jet. A liner is located between the housing and the airtight cavity. A support stand is attached to the container to allow the container to be mounted on a surface for creating a radial cut normal to the surface.

21 Claims, 3 Drawing Sheets

(56) References Cited

U.S. PATENT DOCUMENTS

| | | | | |
|---|---|---|---|---|
| 8,978,558 | B2 * | 3/2015 | Lumley | F42B 1/036 102/307 |
| 9,188,413 | B2 | 11/2015 | McLean et al. | |
| 10,047,583 | B2 * | 8/2018 | Wright | F42B 1/028 |
| 10,921,089 | B1 | 2/2021 | Vabnick et al. | |
| 2005/0081706 | A1 | 4/2005 | Alford | |
| 2005/0126420 | A1 * | 6/2005 | Givens | F42D 3/00 102/310 |
| 2010/0043661 | A1 * | 2/2010 | Graham | F42B 1/028 102/307 |

* cited by examiner

RADIAL RIGID UNDERWATER BETWEEN-STRUCTURE EXPLOSIVE CUTTING CAVITY (RRUBECC) CONTAINER

ORIGIN OF THE INVENTION

The invention described herein was made in the performance of official duties by employees of the U.S. Department of the Navy and may be manufactured, used, or licensed by or for the Government of the United States for any governmental purpose without payment of any royalties thereon.

BACKGROUND

Field of the Invention

The present invention relates to tools for handling explosive cutting charges, and, in particular, to a container for use above and below water to produce radial cuts in-between radial structural components.

Description of the Background

Existing methods to produce underwater cutting rely on straight, linear cuts or axis-symmetric conical shaped charges that are rigid. These may not fit in-between structures or produce a radial cut perpendicular to a plane. Flexible linear charges exist that allow a flexible curve cut to be produced, but lack a means to attach to the target as well as an easy method to initiate the charge. Generally, underwater charges are pre-packed with explosives to provide a watertight fitment to allow the shaped charge jet to form; this can be disadvantageous to the EOD operator, as it requires logistical planning to transport and store a pre-filled charge as compared to an empty cavity container.

SUMMARY

A container can be provided that is made from a 3D printed plastic (porous) plastic material, which is not watertight for underwater use. A blow-molded, air cavity is placed in between the bottom of the liner inside of the housing to create an air-gap for the explosive cutting jet to form as well as provide a standoff distance for the jet. The rigid curved cutting jet may have a hemi-spherical or V-shaped cross-section shaped in the radial dimensions needed. The housing is a clamshell design that allows the user to field-pack plastic explosives (e.g., C-4) into the top of the shell, place the liner, and place the airtight cavity in the bottom or other half of the clamshell enclosure.

According to an aspect of the invention, a radial cutting cavity container includes a housing that defines a chamber for a shaped explosive charge. The housing is configured to allow a user to pack explosives therein. An airtight cavity is attached to the housing. The airtight cavity defines a standoff distance for the shaped explosive charge and has a concave surface adapted to form an explosive cutting jet. A liner is located between the housing and the airtight cavity. A support stand is attached to the container to allow the container to be mounted on a surface for creating a radial cut normal to the surface.

According to an exemplary container for an explosive charge, the container includes a support stand and a housing attached to the support base. The housing is adapted to define a chamber for a shaped explosive charge. An air cavity is attached to the housing. The air cavity is adapted to create an air-gap for an explosive cutting jet to form and to define a standoff distance for the shaped explosive charge. A cavity liner is between the housing and the air cavity. The container is configured to allow a user to pack explosives into the housing cover.

According to an aspect of the invention, an explosive cutting cavity includes a housing having a first portion making up an air cavity and a second portion cooperating with the first portion to form a clamshell enclosure. A liner is situated between the first portion and the second portion. An explosive charge is packed in the second portion. The first portion is shaped with a cross-section to focus the explosive charge through the air cavity and to provide standoff distance for the explosive charge.

DESCRIPTION OF THE DRAWINGS

These and other objects, features and advantages of the present invention will become apparent upon reference to the following description of the exemplary embodiments and to the drawings, wherein corresponding reference characters indicate corresponding parts throughout the several views of the drawings and wherein.

DETAILED DESCRIPTION OF EXEMPLARY EMBODIMENTS

Shaped explosive charges are designed to produce a focused shockwave of great penetrating power directed outwardly along the central axis of an outwardly divergent cavity in one face of the charge. The cavity is usually conical, frusto-conical, or sphero-conical shaped. The cavity cross-section parallel to the base may be circular but, in elongated shaped charges used for linear and curvilinear cutters, it will be rectangular or other elongate form. The explosive composition is usually disposed symmetrically with respect to the cavity axis. In use, the shaped charge is placed with the base of the cavity facing towards the target surface and at an optimum distance for maximum cutting effect. Usually, the cavity is lined with a metal material to enhance the penetrating power.

The housing of the shaped charge device generally extends beyond the base of the cavity of the explosive charge to provide the required standoff, and for underwater charges the cavity and standoff volume are sealed to exclude water. Thus, underwater shaped charge devices generally have a sealed charge casing divided into an explosive charge compartment and a standoff compartment separated by a cavity liner presenting a concave surface within the standoff compartment.

The Radial Rigid Underwater Between-structure Explosive Cutting Cavity (RRUBECC) Container concept enables an improved container for explosive cutting of metal elements underwater using shaped explosive charges and to the shaped explosive charge devices and casings used in the method.

Figure 1:
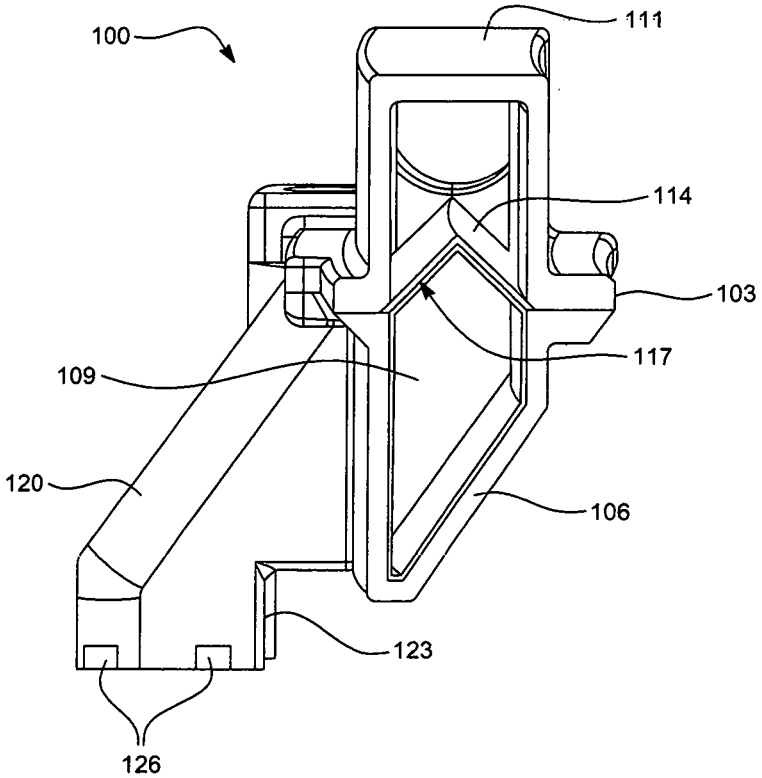
FIG. 1 is a cross-section view of a rigid radial explosive cutting cavity according to devices herein.
Figure 2:
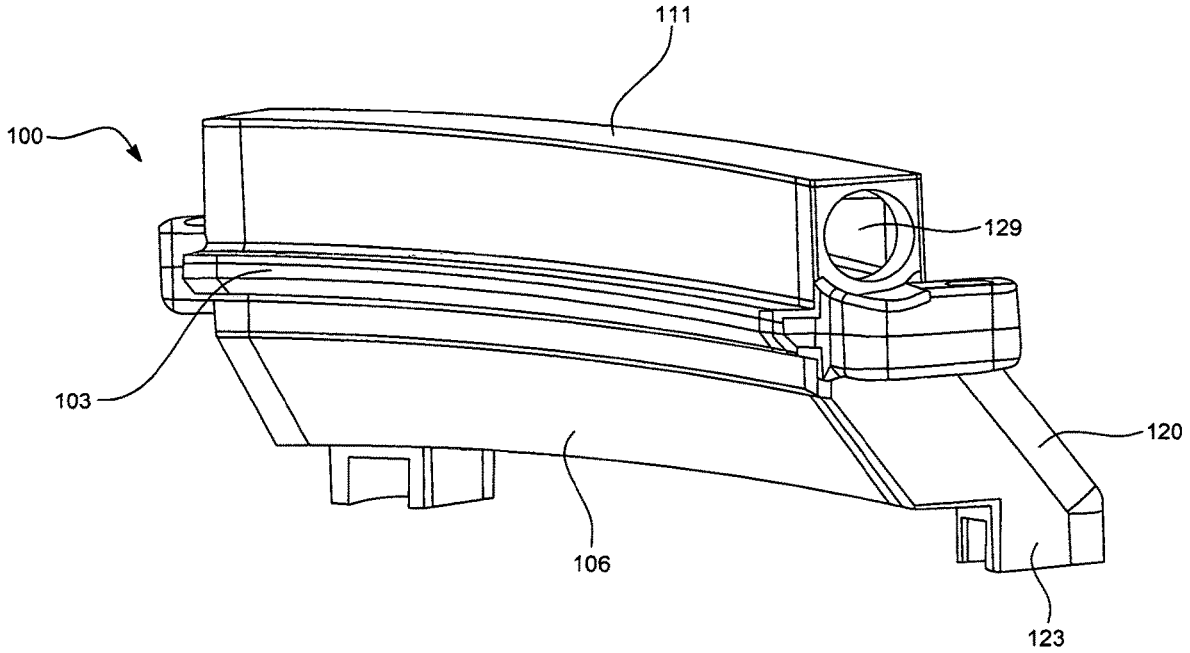
FIG. 2 is a perspective view of a rigid radial explosive cutting cavity according to devices herein.

Referring to FIG. 1, a Radial Rigid Underwater Between-structure Explosive Cutting Cavity (RRUBECC) Container, indicated generally as 100, includes a housing 103 having a first (lower) portion 106 making up an air cavity 109 and a second (upper) portion 111 cooperating with the first portion 106 to form a clamshell enclosure. The housing 103 is curved, as shown in FIG. 2, to fit in-between structures or produce a radial cut perpendicular (normal) to a plane. A liner 114 is between the first portion 106 and the second portion 111. The liner 114 is curved to conform to the shape of the RRUBECC container 100. The second portion 111 defines a chamber for a shaped explosive charge. The housing 103 is configured to allow a user to pack an explosive material, such as a plastic explosive (e.g., C-4), in the upper portion 111.

The first portion 106 is shaped with a cross-section to focus the explosive charge through the air cavity 109 and to provide standoff space for the explosive charge. The first portion 106 has a concave surface 117 adapted to form an explosive cutting jet when in use. The concave surface 117 can be hemi-spherical or V-shaped in cross-section.

A support stand 120 is attached to the housing 103 to allow the container 100 to be mounted on a surface for creating a radial cut normal to the surface. The support stand 120 is horizontally offset from the housing and includes a base 123. Magnets 126 may be embedded into the base 123 of the support stand 120 to allow easy attachment of the RRUBECC container 100 to magnetic (iron-based) surfaces.

As best seen in FIG. 2, an opening 129 is built into the side of the upper portion 111. The opening 129 may be used for a cable gland, or other appropriate device, to hold a blasting cap or detonation cord knot or other device to initiate the explosive charge.

It is contemplated that the RRUBECC container 100 described herein can be manufactured of lightweight plastic and/or by 3D printing or other means now known or developed in the future. For example, some filaments that may be used for 3D printing include ABS (Acrylonitrile Butadiene Styrene) and Polylactic Acid, commonly known as PLA. When superior strength is needed, a carbon fiber-infused nylon filament may be used. The air cavity 109 may be blow-molded for underwater use. The air cavity 109 is placed in between the bottom of the liner 114 inside of the housing 103 to create an air-gap for the explosive cutting jet to form, as well as to provide a standoff distance for the cutting jet.

In use, a user can field-pack plastic explosives (e.g., C-4) into the top portion 111 of the container 100, which is curved to produce radial cuts in-between radial structural components. The liner 114 is placed in the container 103 between the upper portion 111 and the bottom portion 106. The airtight cavity is placed in the bottom portion 106 of the clamshell enclosure. A single blasting cap or detonation cord knot is inserted through the opening 129 built into the side of the upper portion 111 so the blasting cap or detonation cord knot engages the plastic explosive. The container 103 is placed on the surface of a structure where a cut is desired. When the charge is initiated, the shape of the bottom portion 106 and the shape of the liner 114 cooperate to form a cutting jet oriented normal to the surface.

In some cases, a metal liner may not be used. The user can field-pack approximately 40 grams of plastic explosives (e.g., C-4) into the top portion 111 of the container 100, which is curved. This configuration creates a curved shape to the explosive charge. The hollow air gap is located below the explosive. Upon initiation, a plasma jet may be created, which thermally erodes the desired material (target). The ratio of charge width and amount to the air gap length and width is ideal to create a plasma jet. In alternate cases, the user can field-pack a bulk charge explosives into the same location as the air gap, without a metal liner. In this manner, the explosive is in direct contact to the desired material, so that initiation of the explosive charge will break the desired material.

Figure 3:
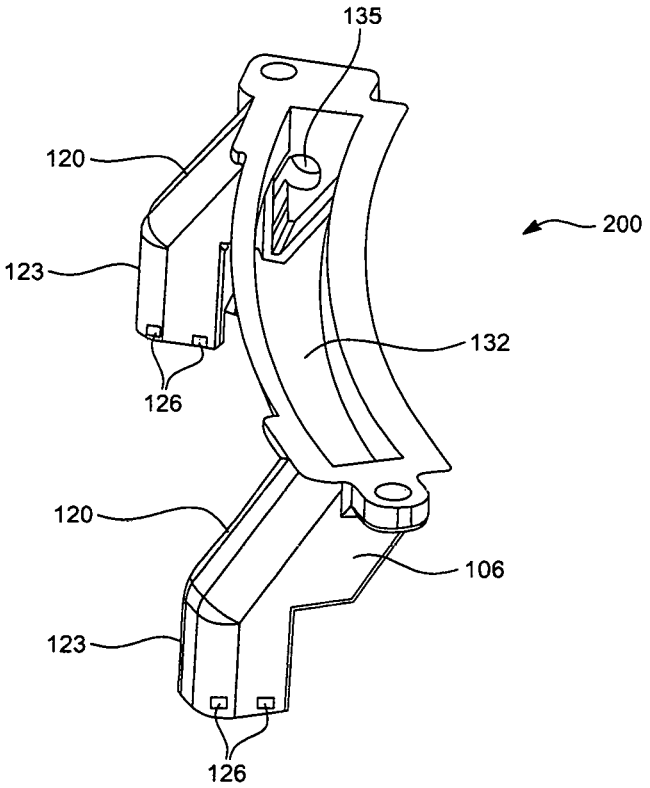
FIG. 3 is a perspective view of an alternate version of a rigid radial explosive cutting cavity according to devices herein.

As shown in FIG. 3, a modified RRUBECC container 200 can be created without a metal liner or the upper portion to place a curved explosive charge directly on the target. In this case, the top 132 of the first portion 106 of the RRUBECC container 200 is open and the bottom is cut out. Such modified RRUBECC container 200 is curved as shown in FIG. 3. An aperture 135 may be provided in the first portion 106. Detonating cord (also referred to as 'de cord') having approximately 50 grams of explosive per foot of det cord is placed in the open, hollow bottom. A single core Uli-knot arrangement can be used in the det cord. Again, in this manner, the curved det cord is in direct contact to the desired material thereby breaking the target upon initiation.

The invention has been described with references to specific embodiments. While particular values, relationships, materials, and steps have been set forth for purposes of describing concepts of the invention, it will be appreciated by persons skilled in the art that numerous variations and/or modifications may be made to the invention as shown in the disclosed embodiments without departing from the spirit or scope of the basic concepts and operating principles of the invention as broadly described. It should be recognized that, in the light of the above teachings, those skilled in the art could modify those specifics without departing from the invention taught herein. Having now fully set forth certain embodiments and modifications of the concept underlying the present invention, various other embodiments as well as potential variations and modifications of the embodiments shown and described herein will obviously occur to those skilled in the art upon becoming familiar with such underlying concept. It is intended to include all such modifications, alternatives, and other embodiments insofar as they come within the scope of the appended claims or equivalents thereof. It should be understood, therefore, that the invention might be practiced otherwise than as specifically set forth herein. Consequently, the present embodiments are to be considered in all respects as illustrative and not restrictive.

The terminology used herein is for the purpose of describing particular systems and methods only and is not intended to be limiting of this disclosure. As used herein, the singular forms "a", "an", and "the" are intended to include the plural forms as well, unless the context clearly indicates otherwise. It will be further understood that the terms "comprises", "comprising", "includes", and/or "including", when used in this specification, specify the presence of stated features, integers, steps, operations, elements, and/or components, but do not preclude the presence or addition of one or more other features, integers, steps, operations, elements, components, and/or groups thereof. Further, the terms "automated" or "automatically" mean that once a process is started (by a machine or a user), one or more machines perform the process without further input from any user.

The corresponding structures, materials, acts, and equivalents of all means or step plus function elements in the claims below are intended to include any structure, material, or act for performing the function in combination with other claimed elements as specifically claimed. The descriptions of the various exemplary embodiments herein have been presented for purposes of illustration but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

For example, terms such as "right", "left", "vertical", "horizontal", "top", "bottom", "upper", "lower", "under", "below", "underlying", "over", "overlying", "parallel", "perpendicular", etc., as used herein, are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements).

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A radial cutting cavity container, comprising:

a housing defining a chamber for an explosive charge, wherein the housing is configured to allow a user to pack plastic explosives therein;

an airtight cavity being attached to the housing, the airtight cavity defines a standoff distance for the explosive charge and has a concave surface adjacent to the housing, the concave surface is adapted to form a cutting jet from the explosive charge;

a liner being situated between the housing and the airtight cavity; and a support stand being attached to the container for allowing the container to be mounted on a surface for creating a radial cut normal to the surface, wherein the housing includes the chamber configured to be in contact with the liner, and wherein the liner is configured to contact the airtight cavity.

2. The radial cutting cavity container according to claim 1, wherein the housing is curve shaped in a radial direction.

3. The radial cutting cavity container according to claim 2, wherein the liner is curve shaped to conform to the shape of the housing.

4. The radial cutting cavity container according to claim 1, further comprising an opening in the housing for admitting a device for initiating the explosive charge.

5. The radial cutting cavity container according to claim 4, further comprising a cable gland being installed in the opening in the housing.

6. The radial cutting cavity container according to claim 1, further comprising magnets being embedded into the support stand.

7. The radial cutting cavity container according to claim 1, wherein the concave surface of the airtight cavity comprises one of a hemi-spherical shape and a V-shape in cross-section.

8. The radial cutting cavity container according to claim 1, wherein the airtight cavity is a blow molded air cavity for underwater use.

9. A container for an explosive charge, comprising:

a support stand;

a housing being attached to the support stand, the housing is adapted to define a chamber for a shaped explosive charge;

an air cavity being attached to the housing, the air cavity is adapted to create an air-gap for an explosive cutting jet to form and to define a standoff distance for the shaped explosive charge; and a cavity liner being situated between the housing and the air cavity, wherein the container is configured to allow a user to pack explosives into the housing, wherein the housing includes the chamber configured to be in contact with the cavity liner, and wherein the cavity liner is configured to contact the air cavity.

10. The container according to claim 9, wherein the housing is curve shaped in a radial direction.

11. The container according to claim 10, wherein the cavity liner is curve shaped to conform to the shape of the housing.

12. The container according to claim 9, further comprising an opening in the housing for admitting a device for initiating the explosive charge.

13. The container according to claim 9, further comprising magnets being embedded into the support stand.

14. The container according to claim 9, wherein the air cavity includes a concave surface adjacent to the housing, and wherein the concave surface is adapted to form a cutting jet from the explosive charge.

15. The container according to claim 14, wherein the concave surface of the air cavity comprises one of a hemi-spherical shape and a V-shape in cross-section.

16. An explosive cutting cavity, comprising:

a housing including a first portion comprising an air cavity and a second portion cooperating with the first portion for forming a clamshell enclosure;

a liner being situated between the first portion and the second portion; and an explosive charge being packed in the second portion, wherein the first portion is shaped with a cross-section to focus the explosive charge through the air cavity and to provide standoff distance for the explosive charge, wherein the housing includes the second portion configured to be in contact with the liner, and wherein the liner is configured to contact the first portion, which includes the air cavity.

17. The explosive cutting cavity according to claim 16, wherein the housing is curved shaped, and wherein the liner is curve shaped to conform to the shape of the housing.

18. The explosive cutting cavity according to claim 16, the second portion further comprising an opening in the side of the second portion for admitting a device for initiating the explosive charge and a cable gland being installed in the opening.

19. The explosive cutting cavity according to claim 16, further comprising a support stand being attached to the housing for allowing the housing to be mounted on a surface for creating a radial cut normal to the surface.

20. The explosive cutting cavity according to claim 16, wherein the air cavity includes a concave surface adjacent to the housing, and wherein the concave surface is adapted to form a cutting jet from the explosive charge.

21. The explosive cutting cavity according to claim 20, wherein the concave surface of the air cavity comprises one of a hemi-spherical shape and a V-shape in cross-section.

* * * * *